US006651750B2

(12) United States Patent
Whitsitt

(10) Patent No.: US 6,651,750 B2
(45) Date of Patent: Nov. 25, 2003

(54) SHEAR RELEASE PACKER AND METHOD OF TRANSFERRING THE LOAD PATH THEREIN

(75) Inventor: John R. Whitsitt, Houston, TX (US)

(73) Assignee: Schlumberger Technology Corporation

( * ) Notice: Subject to any disclaimer, the term of this patent is extended or adjusted under 35 U.S.C. 154(b) by 0 days.

(21) Appl. No.: 09/995,546

(22) Filed: Nov. 28, 2001

(65) Prior Publication Data

US 2002/0070034 A1 Jun. 13, 2002

Related U.S. Application Data

(60) Provisional application No. 60/254,776, filed on Dec. 11, 2000.

(51) Int. Cl.[7] ..... E21B 33/12
(52) U.S. Cl. ..... 166/387; 166/134
(58) Field of Search ..... 166/196, 387, 166/179, 118, 134, 136, 138

(56) References Cited

U.S. PATENT DOCUMENTS 4,387,767 A 6/1983 Read ..... 166/72
4,393,929 A * 7/1983 Akkerman ..... 166/134
4,798,243 A 1/1989 Curington et al. ..... 166/65.1
5,009,265 A 4/1991 Bailey et al. ..... 166/112
5,273,109 A 12/1993 Arizmendi et al. ..... 166/123
5,479,991 A 1/1996 Robison et al. ..... 166/387
5,501,281 A 3/1996 White et al. ..... 166/387
6,056,052 A * 5/2000 Mullen et al. ..... 166/134
6,213,204 B1 * 4/2001 Doane ..... 166/134

* cited by examiner

*Primary Examiner*—David Bagnell
*Assistant Examiner*—Matthew J Smith
(74) *Attorney, Agent, or Firm*—Trop, Pruner & Hu, P.C.; Jeffrey E. Griffin; Brigitte L. Jeffery

(57) ABSTRACT

A shear release packer that includes at least one sealing element, at least one slip, and at least a lower shear nut. In order to release the packer, the lower shear nut is sheared enabling the at least one sealing element to de-energize and the at least one slip to disengage the casing. When set, the packer is constructed to that the lower shear nut is isolated from the load path generated by the forces acting on the at least one sealing element. The load path travels from the at least one sealing element to the at least one slip without having to travel through the lower shear nut.

20 Claims, 6 Drawing Sheets

SHEAR RELEASE PACKER AND METHOD OF TRANSFERRING THE LOAD PATH THEREIN

This application claims priority from U.S. Provisional Patent Application No. 60/254,776, filed Dec. 11, 2000.

BACKGROUND OF THE INVENTION

1. Field of Invention

The present invention relates to the field of downhole tools. More particularly, the present invention relates to packers for use in downhole applications.

2. Related Art

Packers are used to seal off the annulus of a wellbore. A packer is typically run into the wellbore and is then set against the casing of a wellbore so that the packer sealing element seals against the wellbore casing and the packer slips are anchored to the wellbore casing. Some packers are retrievable and include a release mechanism. Upon activation of the release mechanism, the sealing element de-energizes and the anchors are released which enables the movement of the packer from its previously set position.

One type of retrievable packer is a shear release packer. A shear release packer includes a shear nut that is sheared by manipulating the tubing string thereby enabling the release of the packer. Some prior art shear release packers are designed so that, when they are set, the load path between the sealing element and the slips travels primarily through the relevant shear nut, which may be located at the lower end of the packer. Unfortunately, in many instances, the pressure difference across an energized sealing element once set is significant. The force exerted on the packer by this pressure difference tends to act on the packer and attempts to move the packer from its fixed location in the wellbore. Thus, if the force acting on the sealing elements is too high (for example, due to a high differential pressure across the sealing element), such force is transferred from the sealing element and primarily through the shear nut, exposing the shear nut to an extremely high force. This force can sometimes prematurely shear the shear nut and release the packer causing a potentially dangerous and costly situation.

The prior art would therefore benefit from a shear release packer that does not suffer from the aforementioned deficiencies.

SUMMARY OF THE INVENTION

A shear release packer that includes at least one sealing element, at least one slip, and at least a lower shear nut. In order to release the packer, the lower shear nut is sheared enabling the at least one sealing element to de-energize and the at least one slip to disengage the casing. When set, the packer is constructed to that the lower shear nut is isolated from the load path generated by the forces acting on the at least one sealing element. The load path travels from the at least one sealing element to the at least one slip without having to travel through the lower shear nut.

DETAILED DESCRIPTION

Figure 1A:
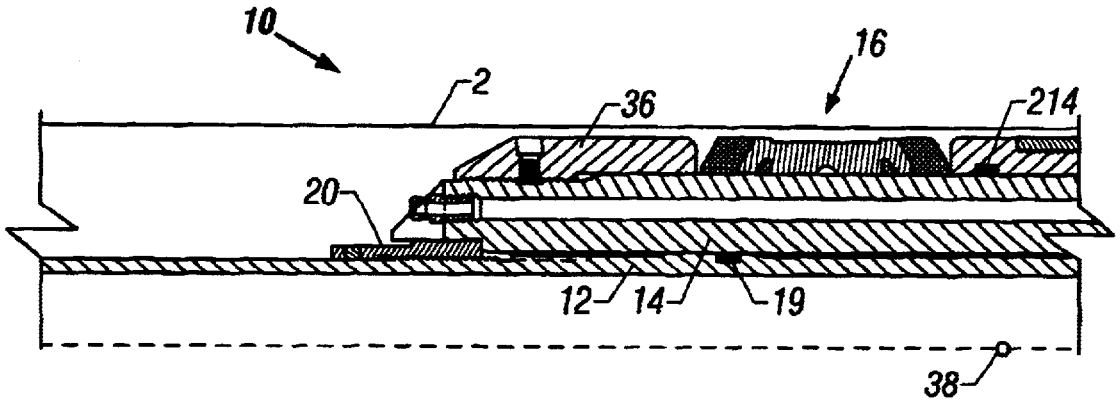
FIGS. 1A–1D are a cross-sectional view of the packer in the deployment configuration.
Figure 2A:
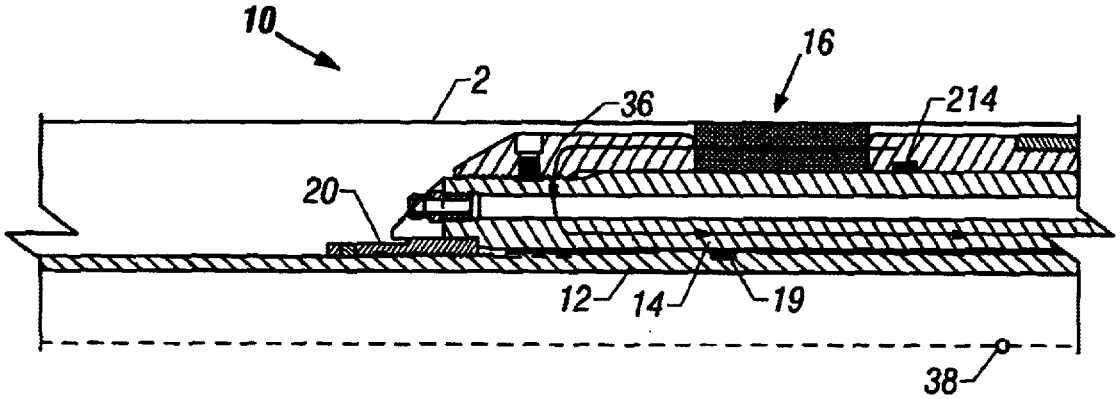
FIGS. 2A–2D are a cross-sectional view of the packer in the set configuration.
Figure 3A:
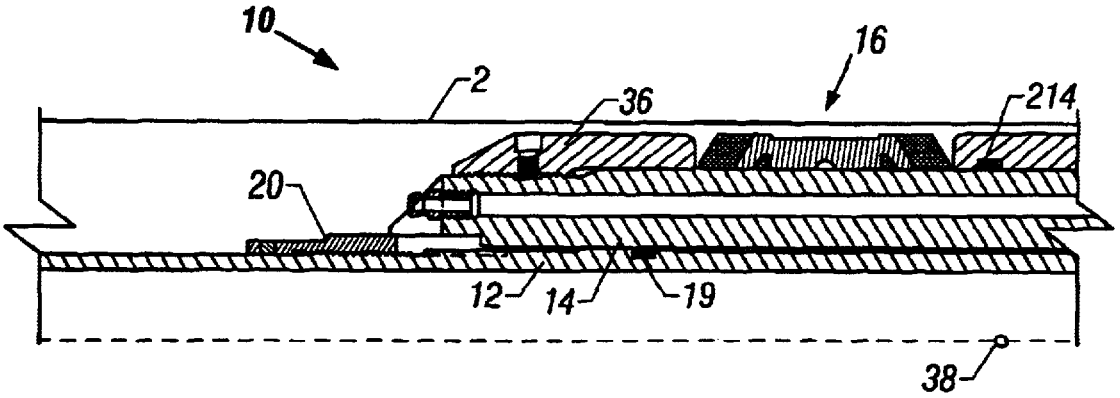
FIGS. 3A–3D are a cross-sectional view of the packer in the set retrieval configuration.
Figure 1B:
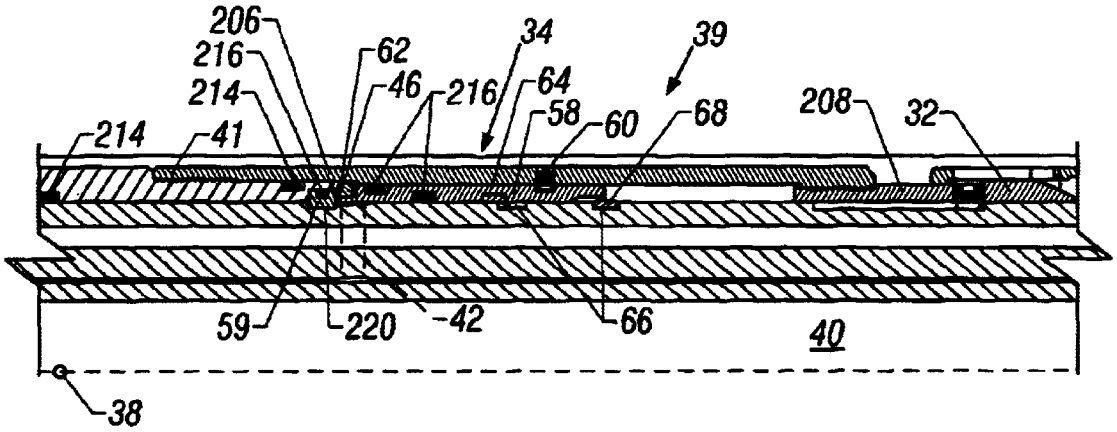
Figure 2B:
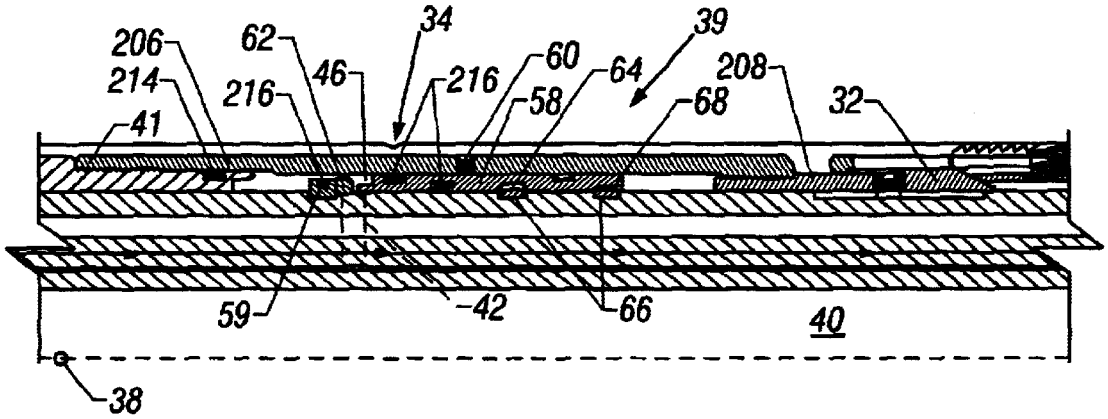
Figure 3B:
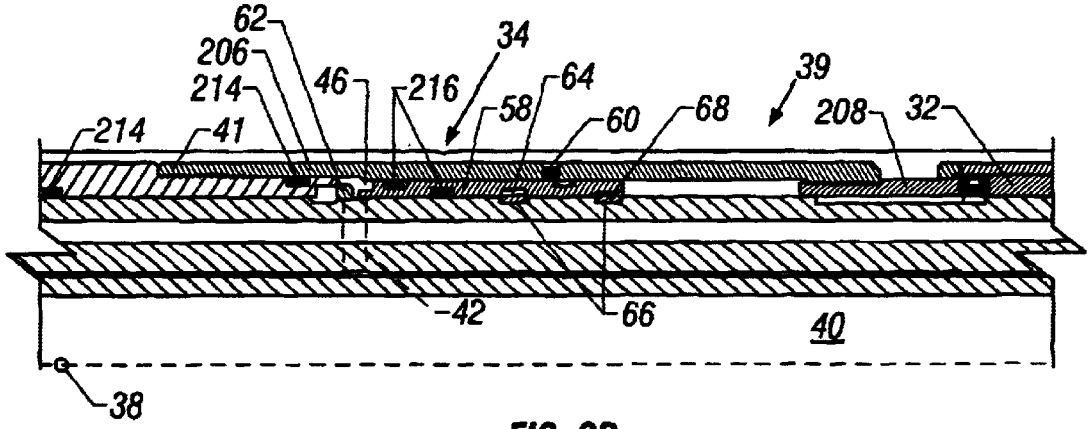
Figure 1C:
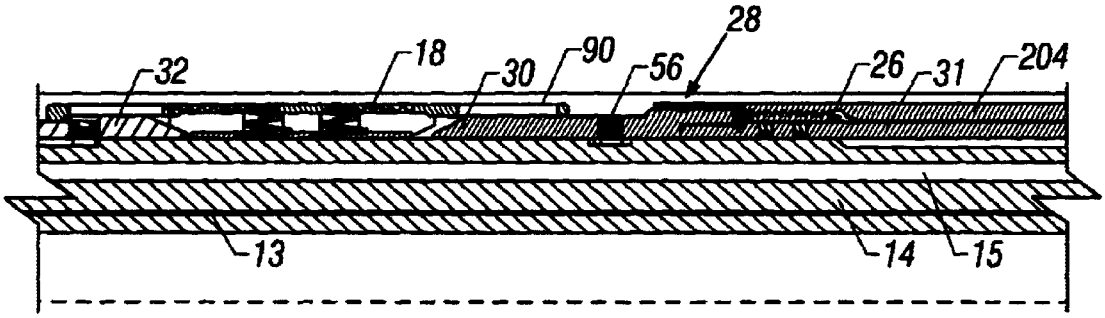
Figure 2C:
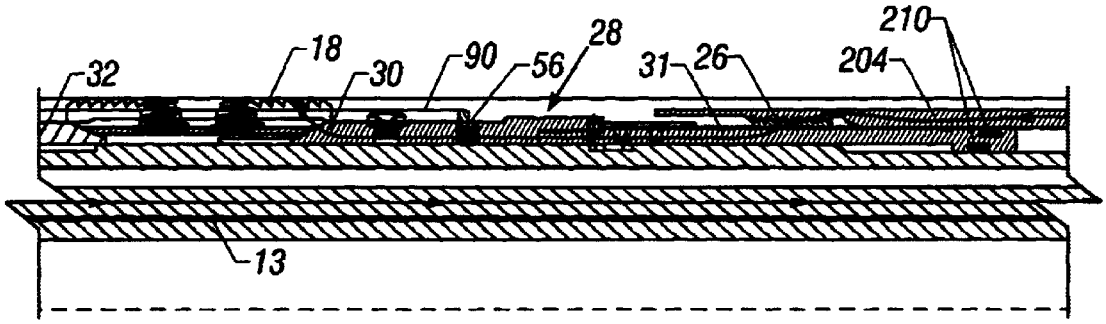
Figure 3C:
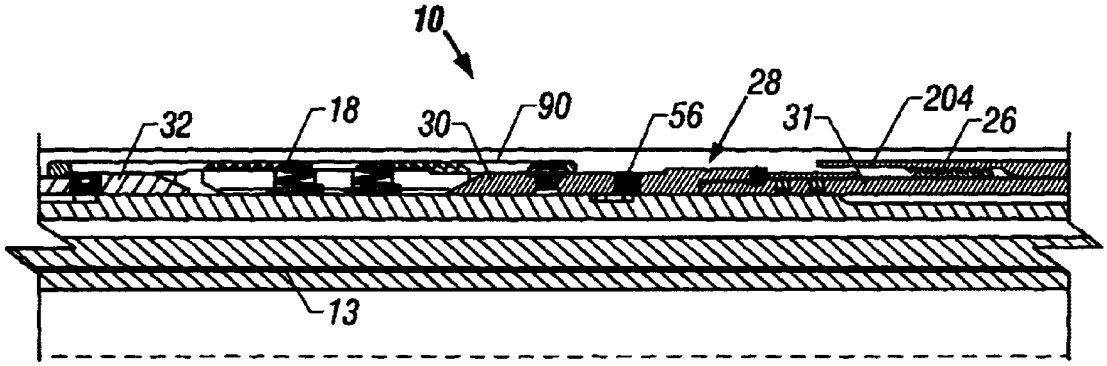
Figure 1D:
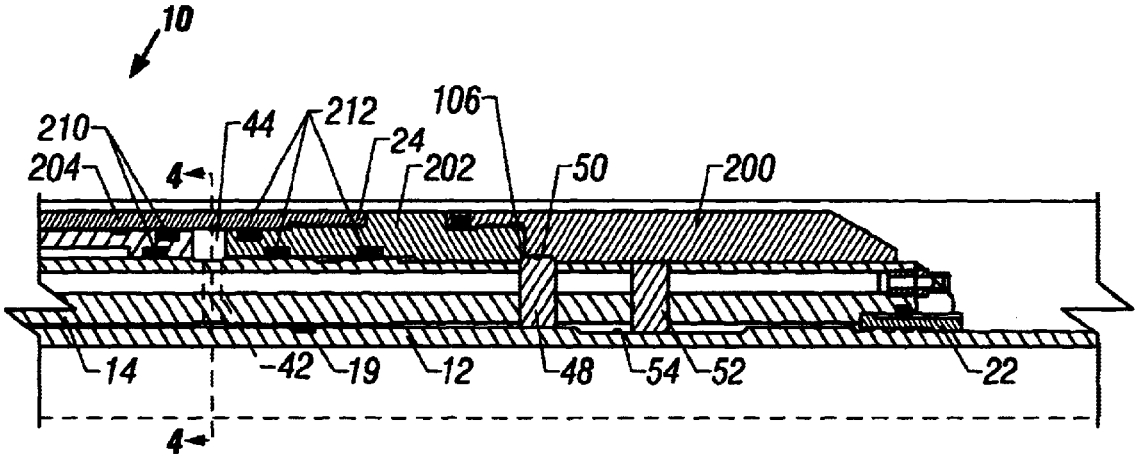
Figure 2D:
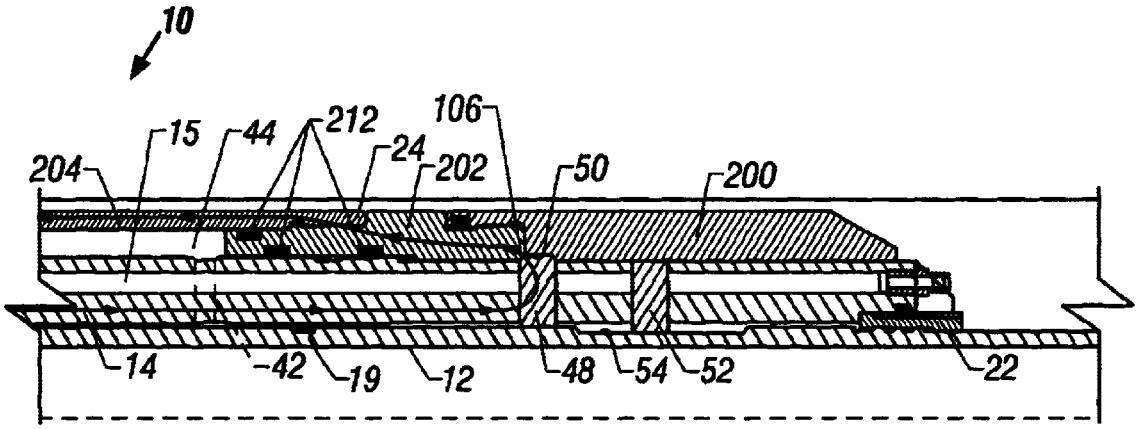
Figure 3D:
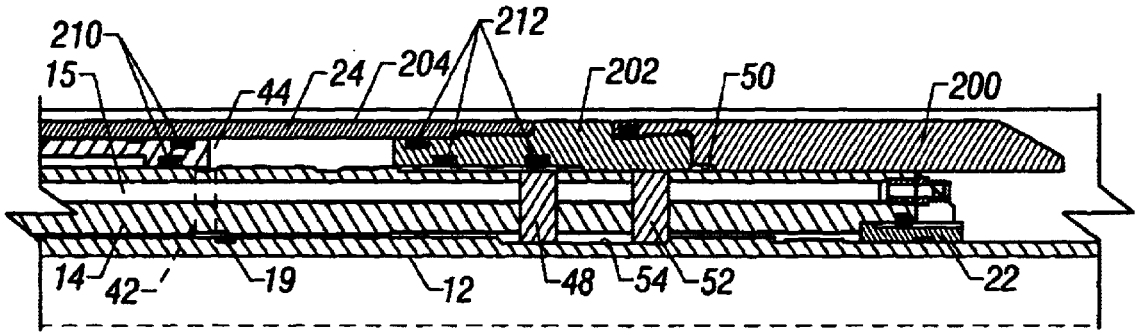

The packer of this invention is generally shown in the Figures as 10. Packer 10 comprises an inner mandrel 12, an outer mandrel 14, at least one sealing element 16, and at least one slip 18. In one embodiment, the outer mandrel 14 concentrically surrounds the inner mandrel 12 forming an area 13 therebetween. In another embodiment (not shown), the outer mandrel 14 and inner mandrel 12 may be eccentrically disposed in relation to each other. Seals 19 are disposed within area 13 between inner mandrel 12 and outer mandrel 14. The sealing element 16 and the slips 18 are operatively attached on the exterior surface of the outer mandrel 14. As is known in the field, sealing element 16 provides a seal between the packer 10 and a casing 2 of a wellbore, while slips 18 securely grip the packer 10 to the casing 2 of the wellbore.

Figure 4:
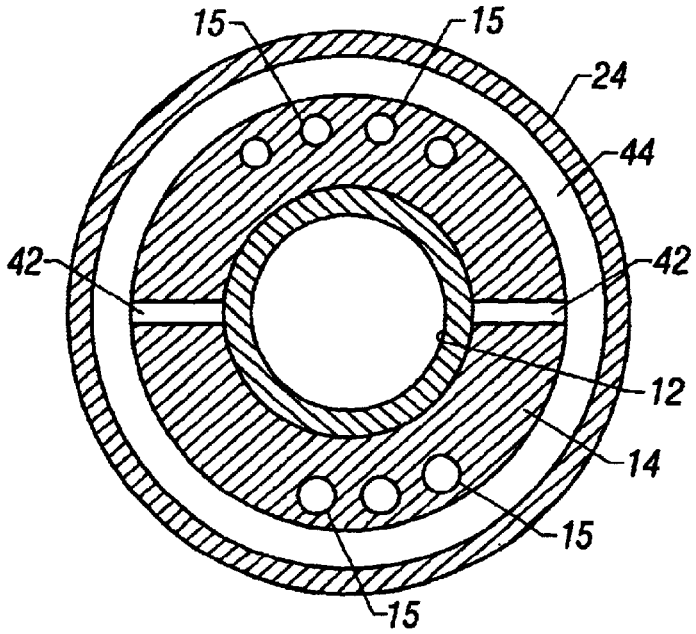
FIG. 4 is a cross-sectional view taken along line 4—4 of FIG. 1D.
Figure 7:
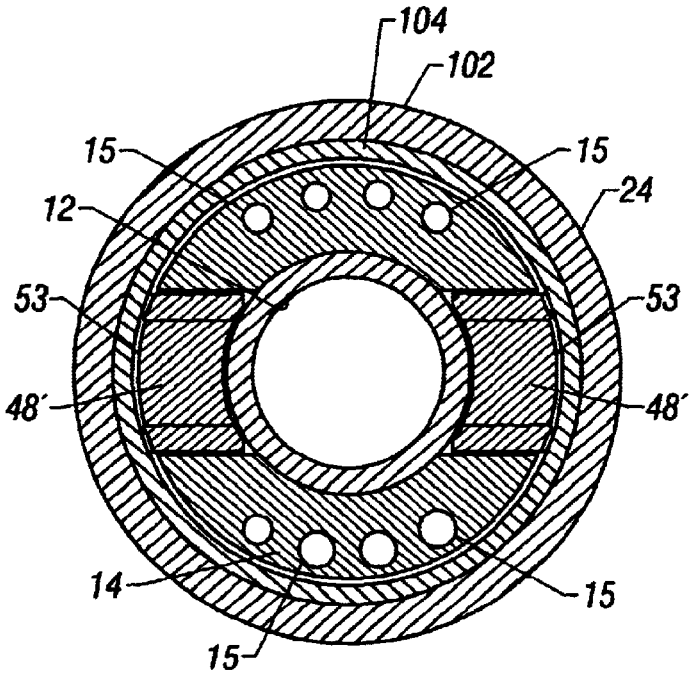
FIG. 7 is a cross-sectional view taken along line 7—7 of FIG. 6.

FIGS. 1A–1D illustrate the packer 10 in its deployment configuration. As can be seen, outer mandrel 14 is not threadably connected to inner mandrel 12. Instead, an upper nut 20 and a lower shear nut 22 are attached to the inner mandrel 12, and the outer mandrel 14 is disposed ("captive") therebetween. Upper nut 20 and lower shear nut 22 act to restrict the movement of outer mandrel 14 on inner mandrel 12. In one embodiment, at least one bypass channel 15 is included through the outer mandrel 14. A plurality of bypass channels 15 may extend through the outer mandrel 14 (as shown in FIGS. 4 and 7). It is understood that a control line (not shown), such as a hydraulic, electric, or fiber optic control line, may be disposed through each bypass channel 15.

An outer sleeve 24 is disposed around the lower part of the outer mandrel 14. In the embodiment shown in the figures, outer sleeve 24 is composed of a lower part 200 that is threadably engaged to a middle part 202 that is threadably engaged to an upper part 204. In other embodiments, outer sleeve 24 can be constructed from one or more parts. The upper end of the outer sleeve 24 (or upper part 204) is secured by way of a ratchet mechanism 26 to a slip actuating assembly 28. The slip actuating assembly 28 includes a lower wedge 30, an upper wedge 32, and a slip piston 31. The slips 18 are located intermediate the lower wedge 30 and the upper wedge 32. The slip piston 31 is selectively slidingly disposed on outer mandrel 14 and is attached to the outer sleeve 24 (to upper part 204) by the ratchet mechanism 26 (as will be disclosed).

The sealing element 16 is located intermediate the sealing element actuating assembly 34 and the upper abutment 36. The upper abutment 36 is fixedly secured (such as by threads) to the upper end of the outer mandrel 14. The sealing element actuating assembly 34 includes a locking mechanism 39 and a sealing element piston 41. The sealing element piston 41 is at one end fixedly attached, such as by threads, to the upper wedge 32. The sealing element piston 41 is at the other end adjacent to the sealing element 16. The sealing element piston 41 is selectively slidingly disposed on outer mandrel 14, and is initially locked in place by the locking mechanism 39. As is shown in the figures, the sealing element piston 41 may be constructed from an upper part 206 and a lower part 208 threadably engaged to each other.

The slip actuating assembly 28 is at least partially kept in place relative to the outer mandrel 14 by at least one first dog 48. In the deployment configuration, the dogs 48 are disposed in the outer mandrel 14 and protrude through the exterior of the outer mandrel 14 into recesses 50 defined in the interior surface of the outer sleeve 24 (on lower part 206), which itself is attached to the slip piston 31 by way of ratchet mechanism 26. The ratchet mechanism 26 allows the upward movement of the slip piston 31 in relation to the outer sleeve 24, but prohibits the downward movement thereof. Initially, the slip piston 31 is secured in place to the outer mandrel 14 by shear pin 56. At least one second dog 52 is also disposed in the outer mandrel 14 and protrudes through the interior of the outer mandrel 14 into a groove 54 defined on the exterior surface of the inner mandrel 12.

It is noted that dogs 48 and 52 in FIGS. 1D, 2D, 3D, and 6 seem to be within bypass channel 15. This view is shown only for purposes of illustration. The actual relative location of the dogs 48 to the bypass channels 15 is shown in FIG. 7. Dogs 52 and bypass channels 15 have a relative location that is similar.

Setting ports 38 are provided in the internal bore 40 of the packer 10 and provide fluid communication between the internal bore 40 and the area 13. Setting passageways 42 (shown in phantom lines in FIGS. 1–3, but clearly shown in FIG. 4) provide fluid communication between the area 13 and the setting chamber 44 of the slip actuating assembly 28 and the setting chamber 46 of the sealing element actuating assembly 34. Seals 19, seals 210 on slip piston 31, and seals 212 on outer sleeve 24 (on middle part 202) act to enable pressurization of setting chamber 44. Likewise, seals 19, seals 214 on sealing element piston 41, and seals 216 on locking mechanism 39 (on retaining sleeve 58 and retaining ring 59) act to enable the pressurization of setting chamber 46.

FIGS. 2A–2D illustrate the packer 10 in its set position. In order to set the packer 10, an operator pressures up the internal bore 40, causing fluid to flow through the setting ports 38 into the area 13 and through the setting passageways 42 into setting chambers 44 and 46.

If high enough, the pressure within the setting chamber 46 causes the locking mechanism 39 to unlock. The locking mechanism 39 includes retaining sleeve 58, retaining ring 59, shear pin 60, first c-ring 62, and second c-ring 64. High enough pressure in the setting chamber 46 causes the retaining sleeve 58 to move downward thereby shearing shear pin 60 which previously connected the retaining sleeve 58 to the sealing element piston 41. As it moves down, the retaining sleeve 58 allows a first c-ring 62, which together with retaining ring 59 (disposed within a groove 220 on outer mandrel 14) previously prohibited the upward movement of the sealing element piston 41, to snap inwardly thereby unlocking the sealing element piston 41 and allowing its upward movement. A second c-ring 64 disposed within the retaining sleeve 58 then snaps into a recess 66 defined on the exterior of the outer mandrel 14 and together with a third c-ring 68 already located in another recess 66, prevents further movement of the retaining sleeve 58. The sealing element piston 41 is now free to move upwards.

Figure 5:
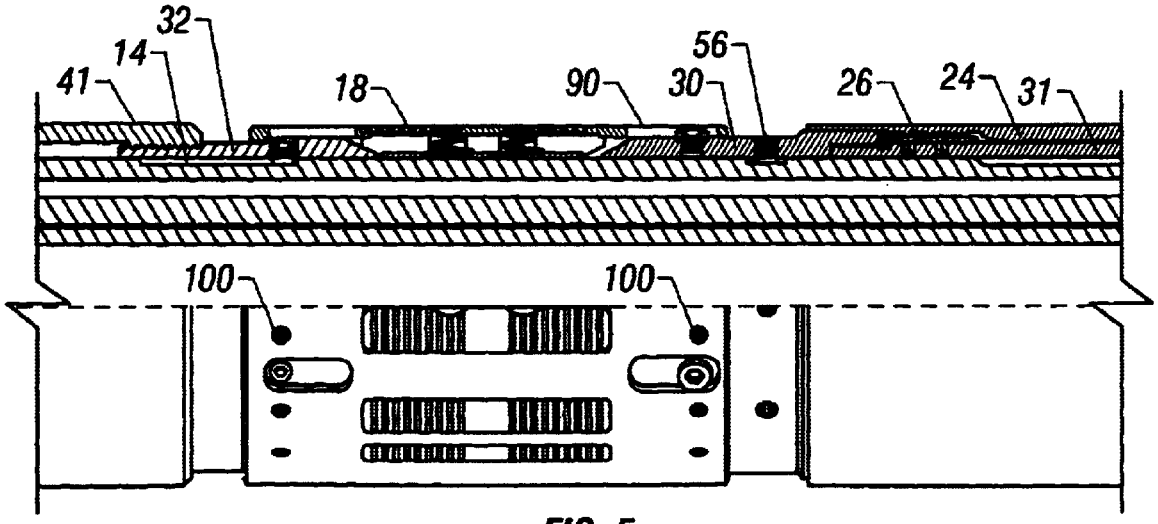
FIG. 5 is a partial cross-sectional view of the packer, showing the shear pins of the cage system.

The pressure within the setting chamber 44 also causes the slip piston 31 to move upwards, shearing shear pin 56 which previously connected the slip piston 31 to the outer mandrel 14. As the slip piston 31 moves up, the ratchet mechanism 26 (between the slip piston 31 and the outer sleeve 24) allows the upward movement of the slip piston 31 in relation to the outer sleeve 24, but prohibits the downward movement thereof. The upward movement is transferred from the slip piston 31 to the sealing element actuating assembly 34 through the slip cage 90, which is connected to the wedges 30, 32 by way of shear pins 100 (see FIG. 5).

Continued upward movement of the sealing element piston 41 and slip piston 31 (now induced by pressure within both setting chambers 44, 46) then compresses the sealing elements 16 against the upper abutment 36 thereby energizing and setting the sealing element 16 against the casing 2. Next, continued application of pressure (particularly through setting chamber 44) and upward force on the slip piston 31 causes the shear pins 100 connecting the slip cage 90 to the wedges 30, 32 to shear. Once such shear pins are sheared, slip piston 31 continues upward movement (with sealing element actuating assembly 34 remaining relatively stationary) and the slips 18 are forced outwardly due to their engagement with wedges 30, 32. Outward movement of the slips 18 results in their grippingly engaging the casing 2. Thus, the slips 18 are set against the casing 2.

The sealing element 16 and slips 18 are locked in their set positions by the ratchet mechanism 26 (which prevents the downward movement of the slip piston 31 in relation to the outer sleeve 24), the dogs 48 (which prevent any movement of the outer sleeve 24 in relation to the outer mandrel 14), the lower shear nut 22 (which prevents the downward movement of the outer mandrel 14 in relation to the inner mandrel 12), the upper abutment 36 (which prevents the upward movement of the sealing element actuating assembly 28 in relation to the outer mandrel 14), and the upper nut 20 (which prevents the upward movement of the outer mandrel 14 in relation to the inner mandrel 12).

In one embodiment, packer 10 is a shear release packer. Thus, packer 10 is released by pulling on the tubing string (not shown) that is connected to the upper end of the inner mandrel 12. FIGS. 3A–3D illustrate the packer 10 in its retrieval configuration. When the tubing string is pulled up and due to its connection to the inner mandrel 12, the inner mandrel 12 attempts to slide in relation to the outer mandrel 14. Since the upper nut 20 is not fixedly connected to the outer mandrel 14 (it merely abuts the outer mandrel 14), all of the force produced by the pulling motion of the inner mandrel 12 is taken by the lower shear nut 22. Lower shear nut 22 is constructed (rated) to be sheared at a certain predetermined force. When the force produced by the pulling motion of the inner mandrel 12 reaches the predetermined shear force, the lower shear nut 22 shears and allows the upward movement of the inner mandrel 12 in relation to the outer mandrel 14. As the inner mandrel 12 slides upwardly, the upper nut 20 slides out of abutment with the outer mandrel 14. In addition, as the inner mandrel 12 slides upwardly, the groove 54 (on inner mandrel 12) also slides upwardly, enabling the first set of dogs 48 to disengage from the recesses 50 (on outer mandrel 14) and to engage the groove 54 (on inner mandrel 12). The second set of dogs 52 remain within groove 54 and act to prohibit further upward movement of the inner mandrel 12 in relation to the outer mandrel 14 when the dogs 52 abut the lower end of the groove 54. Once this occurs, inner mandrel 12 and outer mandrel 14 are lifted as a unit with further pull of the tubing string.

When the dogs 48 become disengaged from the recesses 50, the outer sleeve 24 is no longer supported in the downward direction. Thus, as the packer 10 is continued to be pulled from the wellbore, the outer sleeve 24 begins falling downward. No longer being supported by the outer sleeve 24, the slip actuating assembly 28 (and slip piston 31) also falls downward thereby releasing the slips 18 from the casing 2. No longer being supported by the slip actuating assembly 28, the sealing element actuating assembly 34 (and sealing element piston 41) falls downward thereby releasing the sealing element 16 from the casing 2.

Packer 10 is now completely released and ready to be retrieved from the wellbore. As is known in the art and as shown in the figures, the sealing elements 16, the sealing element actuating assembly 34, the slips 18, the slip actuating assembly 28, and the outer sleeve 24 are all picked up by the outer mandrel 14 as the packer 10 is retrieved to the surface.

In many instances, once the packer 10 and sealing element 16 are set, the pressure difference across the sealing element 16 is significant. The force exerted on the packer by this pressure difference tends to act on the packer 10 and attempts to move the packer from its fixed location in the wellbore. In some prior art shear release packers, this force tends to prematurely shear the relevant shear nut thereby prematurely releasing the packer from its location in the welbore. Some prior art shear release packers suffer from this problem because the load path in such prior art packers between the sealing element and the slips travels primarily through the shear nut. Thus, if the force acting on the sealing elements is too high (for example, due to a high differential pressure across the sealing element), such force is transferred from the sealing element and primarily through the shear nut, exposing the shear nut to an extremely high force.

Packer 10 prevents the lower shear nut 22 from absorbing the majority of the force acting on the sealing elements 16. The load path in the packer 10 is shown with arrows in FIGS. 2A–2D. The load path begins at the sealing element 16, goes through the upper abutment 36, into the upper mandrel 14, down the upper mandrel 14 until it reaches the first set of dogs 48, though the first set of dogs 48, into the outer sleeve 24, through ratchet mechanism 26, through the slip actuating mechanism 28, through the slips 18, and into the casing 2. Thus, the presence of dogs 48 (and the fact that packer 10 is constructed from two concentric mandrels) isolates the lower shear nut 22 from the load path generated by the forces acting on the sealing elements 16 and allows the load path to travel from the outer mandrel 14 to the slips 18 without having to pass through the lower shear nut 22.

Thus, packer 10 provides a novel approach to preventing the premature release of shear release packers when exposed to high pressure differentials across the set sealing element 16.

Figure 6:
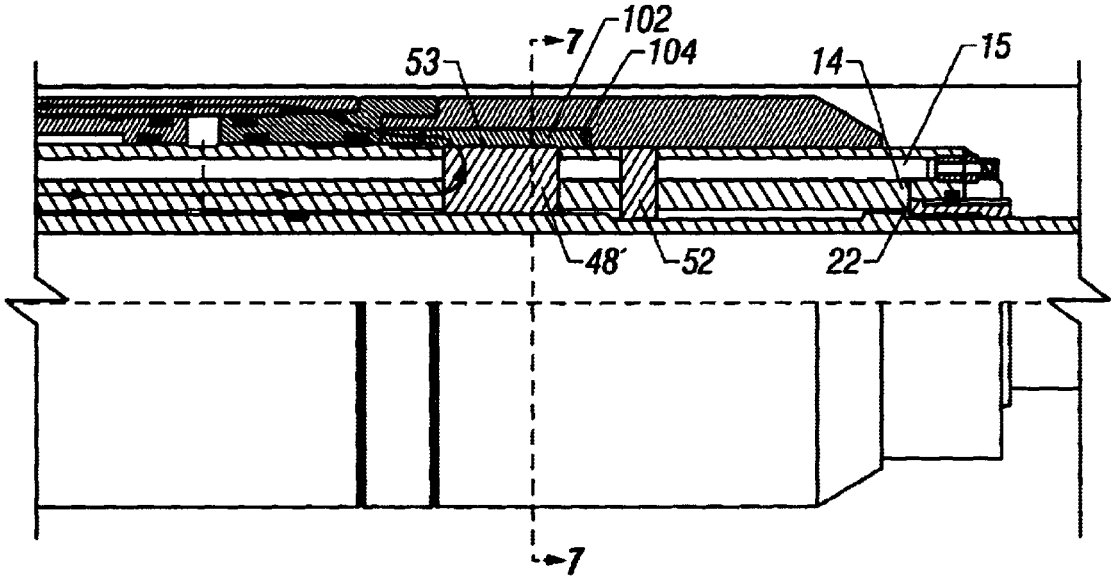
FIG. 6 is a partial cross-sectional view of the lower end of the packer, showing an alternative embodiment of the first set of dogs.

FIGS. 6 and 7 illustrate another embodiment of the at least one first dog and this alternative embodiment is denoted as 48'. In this embodiment, each of the first dogs 48' has an outer surface 53 that is initially threadably engaged to a portion of the outer sleeve 24. The portion of the outer sleeve 24 engaged to the dogs 48' can be a threaded sleeve 102 disposed within a recess 104 of the outer sleeve 24. The dogs 48 of FIGS. 1–3 are constructed so that the load path is transferred through a shoulder 106 of dogs 48. The dogs 48' of FIGS. 6–7, on the other hand, are constructed so that the load path is transferred through the threaded outer surface 53. The threaded outer surface 53 (of dogs 48') has a greater surface area in contact with outer sleeve 24 than the shoulder 106 (of dogs 48). Therefore, the dogs 48' are able to withstand a comparatively greater load therethrough since the load is transferred along the length of the threaded outer surface 53. That is, the load is spread over a greater surface area in the dogs 48' (through outer sleeve 53) when compared to the dogs 48 (through shoulder 106).

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A packer for use in a wellbore adapted to be deployed on a tubing string, comprising:

at least one mandrel;

at least one sealing element adapted to sealingly engage a casing of the wellbore;

at least one slip adapted to grippingly engage the casing;

a shear nut operatively connected to the at least one mandrel so that a sufficient pulling motion on the tubing string shears the shear nut and results in the disengagement of the sealing element and the at least one slip from the casing; and wherein a load path established to maintain engagement of the engaged sealing element and engagement of said at least one slip does not pass through the shear nut.

2. The packer of claim 1, wherein:

the at least one mandrel comprises an inner mandrel and an outer mandrel; and the inner mandrel is disposed within the outer mandrel.

3. The packer of claim 2, wherein the inner mandrel is concentric to the outer mandrel.

4. The packer of claim 1, further comprising:

at least one first dog functionally connected to the sealing element and the at least one slip;

wherein the load path from the engaged sealing element to the engaged at least one slip passes through the at least one first dog.

5. The packer of claim 4, wherein:

the at least one first dog includes a shoulder; and wherein the load path from the engaged sealing element to the engaged at least one slip passes through the shoulder of the at least one first dog.

6. The packer of claim 4, wherein:

the at least one first dog includes a threaded outer surface; and wherein the load path from the engaged sealing element to the engaged at least one slip passes through the threads of the at least one first dog.

7. The packer of claim 4, wherein:

the at least one mandrel comprises an inner mandrel and an outer mandrel; and the inner mandrel is disposed within the outer mandrel.

8. The packer of claim 7, wherein the outer mandrel includes at least one bypass channel extending therethrough.

9. The packer of claim 7 wherein the at least one bypass channel comprises a plurality of bypass channels.

10. The packer of claim 7, wherein the at least one first dog is functionally connected to the outer mandrel.

11. The packer of claim 10, wherein the at least one first dog is disposed in the outer mandrel.

12. The packer of claim 11, further comprising:

an outer sleeve surrounding the outer mandrel;

when the sealing element and the at least one slip are engaged to the casing, the at least one first dog protrudes through an exterior of the outer mandrel into a recess defined in an interior surface of the outer sleeve; and wherein the load path from the engaged sealing element to the engaged at least one slip passes through the at least one first dog and through the outer sleeve.

13. The packer of claim 12, wherein:

the at least one first dog includes a shoulder; and wherein the load path from the engaged sealing element to the engaged at least one slip passes through the shoulder of the at least one first dog and through the outer sleeve.

14. The packer of claim 12, wherein:

the at least one first dog includes an outer surface that is threadably engaged to a portion of the outer sleeve; and wherein the load path from the engaged sealing element to the engaged at least one slip passes through the threaded engagement between the at least one first dog and the portion of the outer sleeve.

15. The packer of claim 14, wherein:

the outer sleeve includes a threaded sleeve disposed within a recess of the outer sleeve; and the at least one first dog is threadably engaged to the threaded sleeve.

16. A shear release packer for use in a wellbore, comprising:

at least one sealing element adapted to sealingly engage a casing of the wellbore;

at least one slip adapted to grippingly engage the casing;

a shear nut that upon shearing enables the disengagement of the sealing element and the at least one slip from the casing; and wherein the shear nut is isolated from a load path established to maintain an engaged state of the engaged sealing element and an engaged state of said at least one slip.

17. The packer of claim 16, further comprising:

at least one first dog functionally connected to the sealing element and the at least one slip;

wherein the load path from the engaged sealing element to the engaged at least one slip passes through the at least one first dog.

18. The packer of claim 17, wherein:

the at least one first dog includes a shoulder; and wherein the load path from the engaged sealing element to the engaged at least one slip passes through the shoulder of the at least one first dog.

19. The packer of claim 17, wherein:

the at least one first dog includes a threaded outer surface; and wherein the load path from the engaged sealing element to the engaged at least one slip passes through the threads of the at least one first dog.

20. A method of transferring the load path in a shear release packer, comprising:

sealingly engaging a sealing element to the casing;

grippingly engaging at least one slip to the casing;

isolating a load path used to maintain the sealing element in its engaged state and to maintain said at least one slip in its engaged state without allowing it to pass through a shear nut, the shear nut upon shearing enabling the disengagement of the sealing element and said at least one slip from the casing.

* * * * *